US012757941B2

(12) United States Patent
Chen

(10) Patent No.: US 12,757,941 B2
(45) Date of Patent: Oct. 13, 2026

(54) ELECTRONIC VAPORIZATION DEVICE AND VAPORIZER THEREOF

(71) Applicant: Shenzhen Verdewell Technology Limited, Shenzhen (CN)

(72) Inventor: Shouhao Chen, Shenzhen (CN)

(73) Assignee: Shenzhen Verdewell Technology Limited, Shenzhen (CN)

( * ) Notice: Subject to any disclaimer, the term of this patent is extended or adjusted under 35 U.S.C. 154(b) by 487 days.

(21) Appl. No.: 18/358,978

(22) Filed: Jul. 26, 2023

(65) Prior Publication Data

US 2024/0041124 A1 Feb. 8, 2024

(30) Foreign Application Priority Data

Aug. 4, 2022 (CN) ..... 202222067862.9

(51) Int. Cl.

| | |
|---|---|
| ***A24F 40/48*** | (2020.01) |
| ***A24F 7/00*** | (2006.01) |
| ***A24F 40/10*** | (2020.01) |
| ***A24F 40/42*** | (2020.01) |
| ***A24F 40/44*** | (2020.01) |
| ***A24F 40/46*** | (2020.01) |

(52) U.S. Cl.

CPC ..... *A24F 40/48* (2020.01); *A24F 7/00* (2013.01); *A24F 40/10* (2020.01); *A24F 40/42* (2020.01); *A24F 40/44* (2020.01); *A24F 40/46* (2020.01)

(58) Field of Classification Search

CPC ..... A24F 40/48; A24F 40/10; A24F 40/46; A24F 40/44; A24F 40/42; A24F 7/00

See application file for complete search history.

(56) References Cited

U.S. PATENT DOCUMENTS

2014/0069424 A1* 3/2014 Poston ..... A61M 15/06 128/202.21
2017/0006923 A1* 1/2017 Li ..... A24F 40/485
(Continued)

FOREIGN PATENT DOCUMENTS

CN 204056736 U 12/2014
CN 110250579 A * 9/2019 ..... A61M 11/00
(Continued)

OTHER PUBLICATIONS

Canadian Intellectual Property Office, First Office Action in Canadian Patent Application No. 3,205,842 (Oct. 30, 2024).

*Primary Examiner* — Katelyn W Smith
*Assistant Examiner* — Thomas Frank Schneider
(74) *Attorney, Agent, or Firm* — Leydig, Voit & Mayer, Ltd.

(57) ABSTRACT

A vaporizer includes: a liquid storage housing; a vent tube arranged in the liquid storage housing, a liquid storage cavity being formed between an inner surface of the liquid storage housing and an outer surface of the vent tube; and a piston sealingly arranged between the inner surface of the liquid storage housing and the outer surface of the vent tube, the piston having a first surface and a second surface arranged opposite each other, the first surface being in communication with atmosphere, the second surface being in communication with the liquid storage cavity. The piston is movable in the liquid storage housing under air pressure of the atmosphere so as to change a volume of the liquid storage cavity.

15 Claims, 5 Drawing Sheets

(56) References Cited

U.S. PATENT DOCUMENTS

| | | | | |
|---|---|---|---|---|
| 2018/0317551 | A1* | 11/2018 | Daryani | A24F 40/48 |
| 2020/0305500 | A1* | 10/2020 | Liu | A24F 40/42 |
| 2023/0157367 | A1* | 5/2023 | Liao | A24F 40/10<br>131/329 |

FOREIGN PATENT DOCUMENTS

| | | | | |
|---|---|---|---|---|
| CN | 106998815 | B | 2/2020 | |
| WO | WO-2016074236 | A1 * | 5/2016 | H05B 1/0227 |
| WO | WO-2016141556 | A1 * | 9/2016 | A24F 40/485 |
| WO | WO-2017082728 | A1 * | 5/2017 | A24F 40/42 |

* cited by examiner

ELECTRONIC VAPORIZATION DEVICE AND VAPORIZER THEREOF

CROSS-REFERENCE TO PRIOR APPLICATION

Priority is claimed to Chinese Patent Application No. 202222067862.9, filed on Aug. 4, 2022, the entire disclosure of which is hereby incorporated by reference herein.

FIELD

The utility model relates to the field of vaporization, and in particular, to an electronic vaporization device and a vaporizer thereof.

BACKGROUND

An electronic vaporization device is configured to heat and vaporize a vaporizable liquid substrate to generate an aerosol available for absorption. The electronic vaporization device continuously consumes the liquid substrate in a liquid storage cavity during inhalation. As the liquid substrate in the liquid storage cavity is continuously consumed, the air pressure in the liquid storage cavity decreases, which may cause the liquid substrate in the liquid storage cavity to be unable to feed or to feed unsmoothly and even lead to dry heating of the heating element. A typical electronic vaporization device usually uses a vent hole to introduce the outside air into the liquid storage cavity, but the air entering the liquid storage cavity may cause contamination of the liquid substrate.

SUMMARY

In an embodiment, the present invention provides a vaporizer, comprising: a liquid storage housing; a vent tube arranged in the liquid storage housing, a liquid storage cavity being formed between an inner surface of the liquid storage housing and an outer surface of the vent tube; and a piston sealingly arranged between the inner surface of the liquid storage housing and the outer surface of the vent tube, the piston having a first surface and a second surface arranged opposite each other, the first surface being in communication with atmosphere, the second surface being in communication with the liquid storage cavity, wherein the piston is movable in the liquid storage housing under air pressure of the atmosphere so as to change a volume of the liquid storage cavity.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
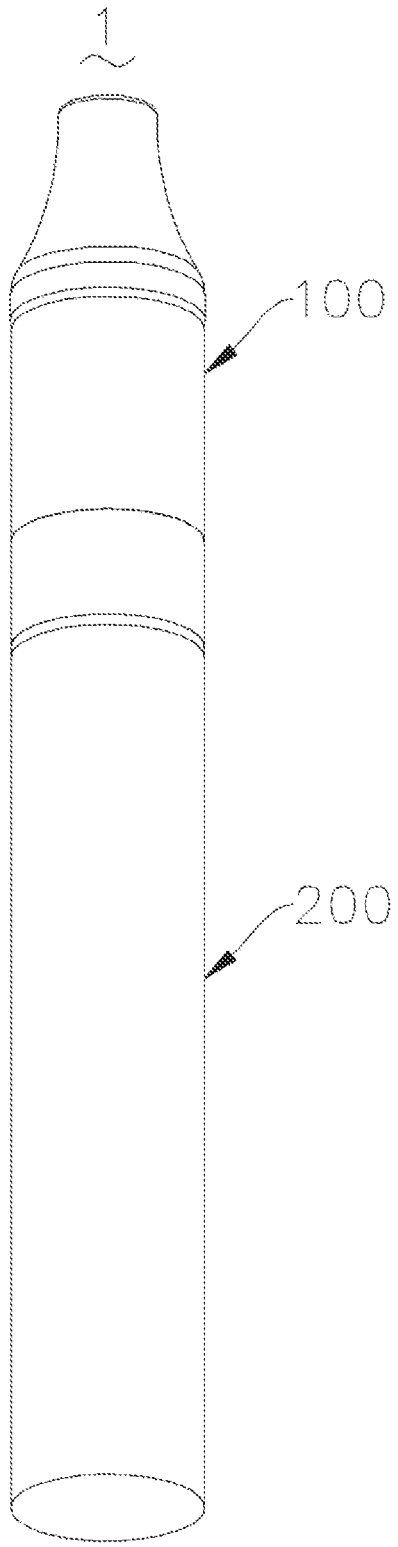
FIG. 1 is a schematic diagram of a three-dimensional structure of an electronic vaporization device according to some embodiments of the utility model.

In an embodiment, the present invention provides an improved vaporizer and an electronic vaporization device having the vaporizer for the foregoing defects in the prior art.

In an embodiment, the present invention provides a vaporizer, including:

a liquid storage housing;

a vent tube, arranged in the liquid storage housing, where a liquid storage cavity is formed between the inner surface of the liquid storage housing and the outer surface of the vent tube; and a piston, sealingly arranged between the inner surface of the liquid storage housing and the outer surface of the vent tube.

The piston has a first surface and a second surface arranged opposite to each other, the first surface is in communication with the atmosphere, the second surface is in communication with the liquid storage cavity, and the piston is movable in the liquid storage housing under the air pressure of the atmosphere, thereby changing a volume of the liquid storage cavity.

In some embodiments, the inner surface of the piston protrudes to form a first seal ring, which is annular, and the first seal ring is in seal-fit with the outer surface of the vent tube.

In some embodiments, the outer surface of the piston protrudes to form a second seal ring, which is annular, and the second seal ring is in seal-fit with the inner surface of the liquid storage housing.

In some embodiments, the vaporizer further includes a mouthpiece arranged at the upper end of the liquid storage housing, where the mouthpiece includes a mouthpiece portion, an air cavity is annular and formed between the lower end surface of the mouthpiece portion and the first surface, and the air cavity is in communication with the atmosphere.

In some embodiments, a spacing is formed between the lower end surface of the mouthpiece portion and the upper end surface of the liquid storage housing.

In some embodiments, the mouthpiece further includes a limiting portion extending downward from the lower end surface of the mouthpiece portion, and the piston has a first position abutting against the limiting portion.

In some embodiments, the mouthpiece further includes a sleeve portion extending downward from the limiting portion, and the sleeve portion is embedded in the vent tube.

In some embodiments, the vaporizer further includes a vaporization assembly arranged in the liquid storage housing, where the vaporization assembly includes a liquid absorbing element in fluid communication with the liquid storage cavity and a heating element arranged in the liquid absorbing element.

In some embodiments, the vaporization assembly is arranged in the vent tube.

In some embodiments, the vaporizer further includes a base arranged at the lower end of the liquid storage housing and an electrode pin extending through the base, where the electrode pin is electrically connected to a first electrode of the liquid absorbing element.

In some embodiments, the lower end of the vent tube is embedded in the base.

In some embodiments, the vent tube is conductive, and the vent tube is electrically connected to a second electrode of the liquid absorbing element.

In some embodiments, the vaporizer further includes an insulating sleeve, where the insulating sleeve is arranged between the inner surface of the vent tube and the outer surface of the electrode pin.

The utility model further provides an electronic vaporization device, including the vaporizer according to any of the above.

Implementing the utility model brings at least the following beneficial effects: By arranging a movable piston in the liquid storage housing, when the liquid substrate in the liquid storage cavity is reduced and the air pressure in the liquid storage cavity is reduced, the piston can move under the action of the atmospheric pressure, and the volume in the liquid storage cavity can be reduced, which increases the air pressure in the liquid storage cavity, and avoids the unsmooth or impossible feeding of liquid due to excessively small air pressure in the liquid storage cavity. According to the utility model, a vent hole does not need to be arranged to introduce the outside air into the liquid storage cavity, thereby preventing the outside air from polluting a liquid substrate in the liquid storage cavity.

In order to have a clearer understanding of the technical features, the objectives, and the effects of the utility model, specific implementations of the utility model are now illustrated in detail with reference to the accompanying drawings. In the following description, many specific details are described for thorough understanding of the utility model. However, the utility model may be implemented in many other manners different from those described herein. A person skilled in the art may make similar improvements without departing from the connotation of the utility model. Therefore, the utility model is not limited to the specific embodiments disclosed below.

In the description of the utility model, it should be understood that orientation or position relationships indicated by the terms such as "longitudinal", "transverse", "width", "thickness", "front", "back", "up", "down", "left", "right", "top", "bottom", "inside", "outside" and the like are based on orientation or position relationships shown in the accompanying drawings, and are used only for ease and brevity of illustration and description, rather than indicating or implying that the mentioned apparatus or component need to have a particular orientation or need to be constructed and operated in a particular orientation. Therefore, such terms should not be construed as limiting of the utility model.

In addition, terms "first" and "second" are used merely for the purpose of description, and shall not be construed as indicating or implying relative importance or implying a quantity of indicated technical features. Therefore, a feature restricted by "first" or "second" may explicitly indicate or implicitly include at least one of such features. In the descriptions of the utility model, unless otherwise explicitly and specifically defined, "multiple" means at least two, for example, two or three.

In the utility model, it should be noted that unless otherwise explicitly specified and limited, the terms "mount", "connect", "connection", and "fix" should be understood in a broad sense. For example, a connection may be a fixed connection, a detachable connection, or an integral connection; or the connection may be a mechanical connection or an electrical connection; or the connection may be a direct connection, an indirect connection through an intermediary, or internal communication between two elements or mutual action relationship between two elements, unless otherwise specified explicitly. A person of ordinary skill in the art can understand specific meanings of the terms in the present utility model according to specific situations.

In the utility model, unless otherwise explicitly specified or defined, the first feature being located "above" or "below" the second feature may be the first feature being in a direct contact with the second feature, or the first feature being in an indirect contact with the second feature through an intermediary. In addition, the first feature is "above" the second feature may indicate that the first feature is directly above or obliquely above the second feature, or may merely indicate that the horizontal position of the first feature is higher than that of the second feature. The first feature is "below", "under", and "beneath" the second feature may be that the first feature is right below the second feature or at an inclined bottom of the second feature, or may merely indicate that the horizontal position of the first feature is lower than that of the second feature.

Figure 2:
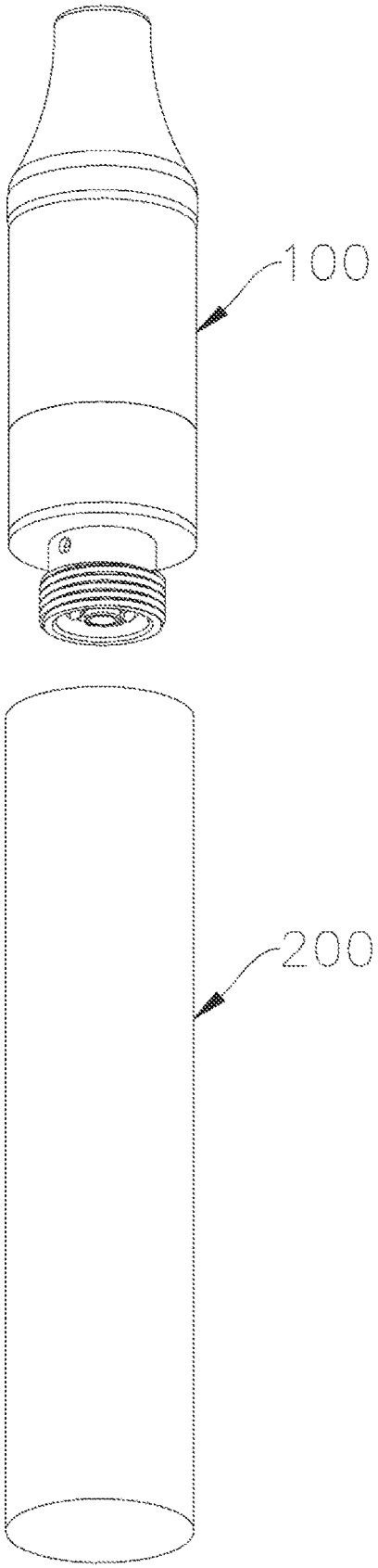
FIG. 2 is a schematic diagram of a breakdown structure of the electronic vaporization device shown in FIG. 1.

FIG. 1 and FIG. 2 show an electronic vaporization device 1 according to some embodiments of the utility model. The electronic vaporization device 1 may include a vaporizer 100 and a power supply device 200 matedly connected to the vaporizer 100. The vaporizer 100 is configured to accommodate a liquid substrate and heat and vaporize the liquid substrate after power-on to generate an aerosol. The vaporizer 100 may be longitudinally arranged in an upper portion of the power supply device 200, and may be connected to the power supply device 200 by a detachable manner such as screw connection, magnetic suction connection, or snap connection. The power supply device 200 is configured to power the vaporizer 100 and may control an operation such as opening and closing of an entire electronic vaporization device 1. A battery for powering the vaporizer 100 and a control circuit for controlling the heating of the vaporizer 100 are generally arranged therein. It may be understood that in other embodiments, the vaporizer 100 may be connected with the power supply device 200 in a non-detachable manner.

Figure 3:
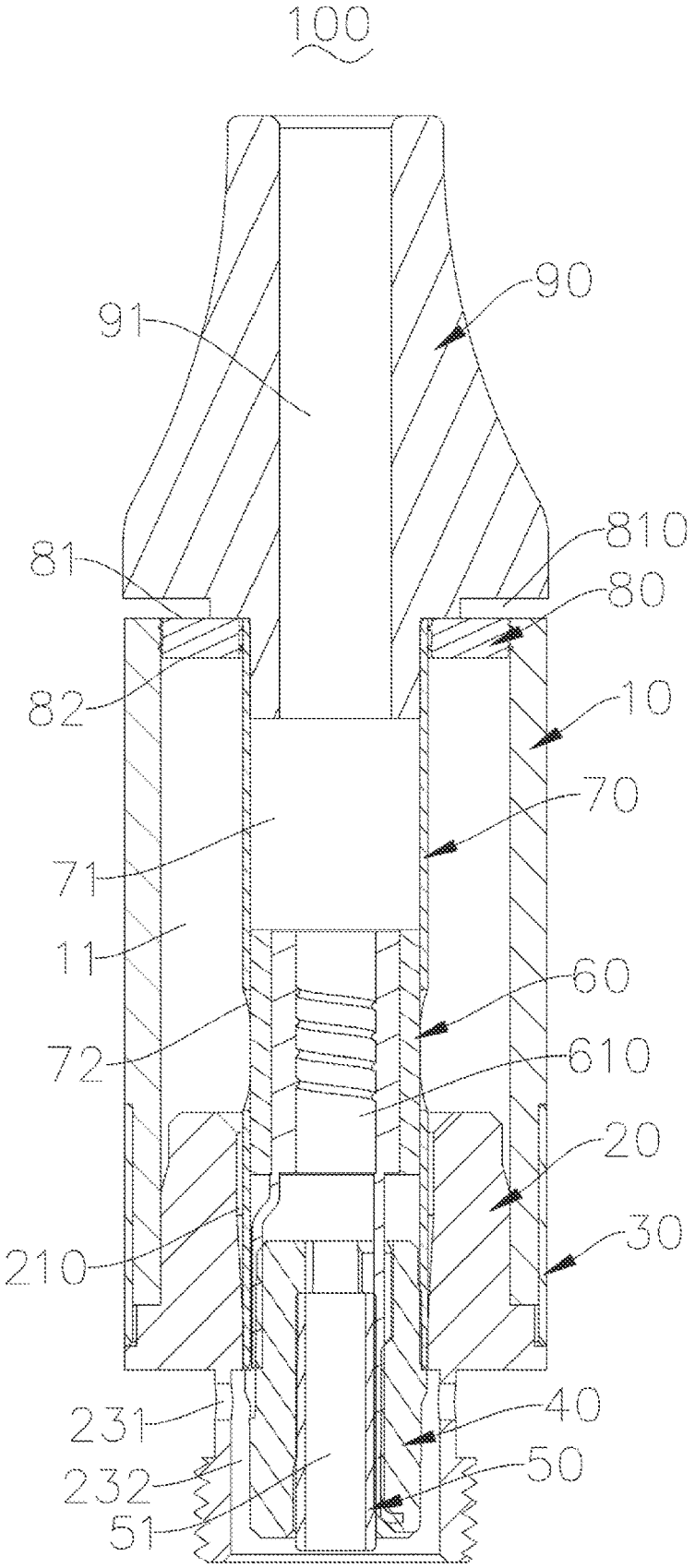
FIG. 3 is a schematic longitudinal cross-sectional view of a vaporizer in FIG. 2 with a piston being at a first position.
Figure 4:
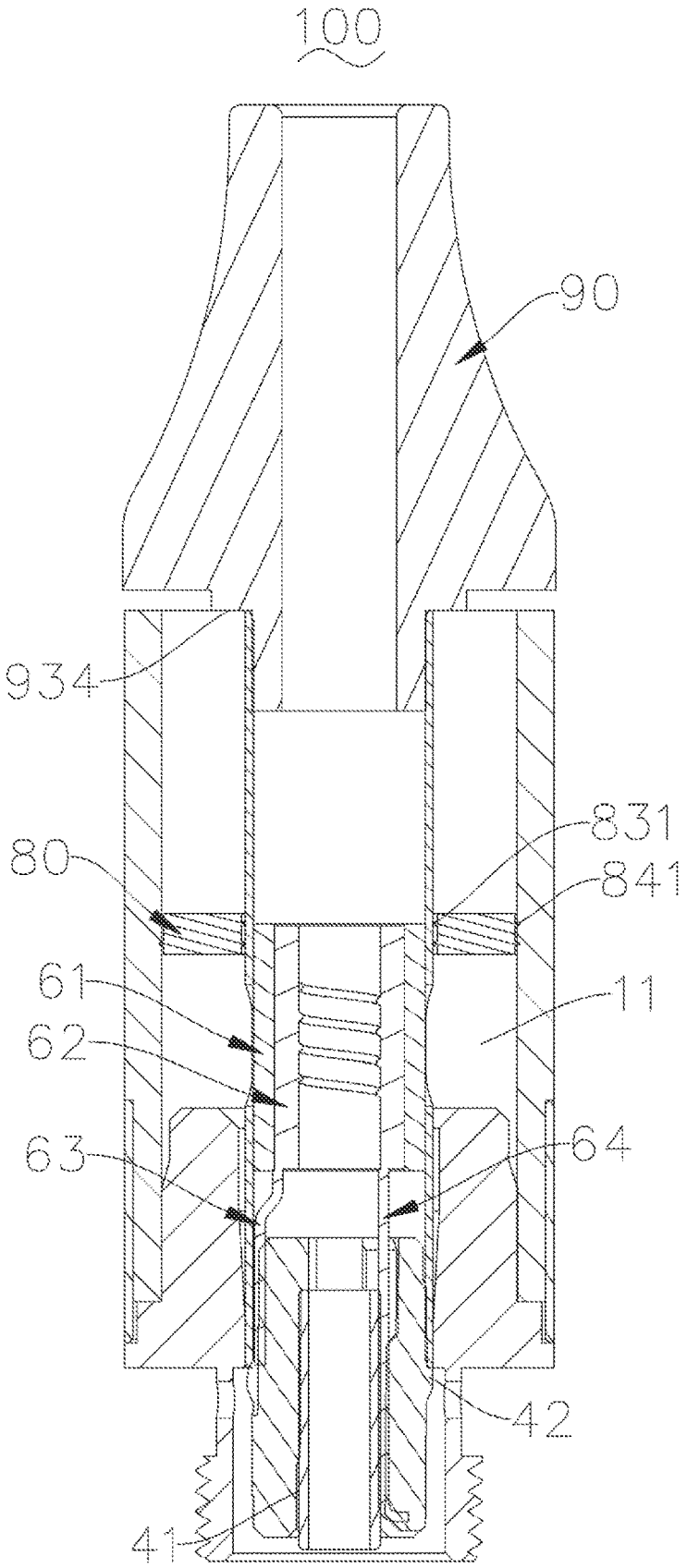
FIG. 4 is a schematic longitudinal cross-sectional view of a vaporizer in FIG. 2 with a piston being at a second position.
Figure 5:
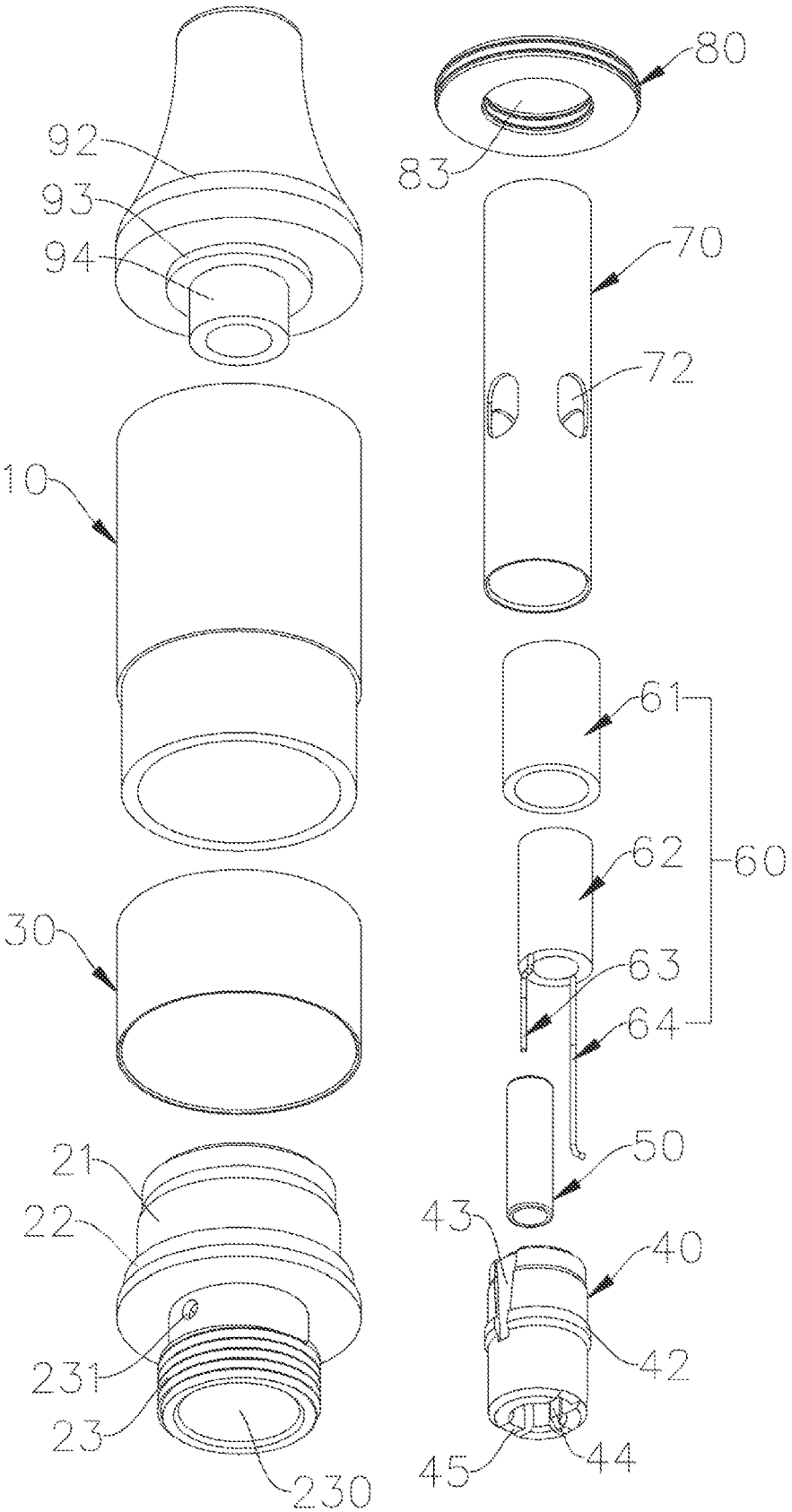
FIG. 5 is a schematic exploded structural view of a vaporizer in FIG. 2.

As shown in FIG. 3 to FIG. 5, the vaporizer 100 may include a liquid storage housing 10, a base 20, a mouthpiece 90, a vaporization assembly 60, a vent tube 70, and a piston 80. The base 20 and the mouthpiece 90 are respectively arranged at both ends of the liquid storage housing 10. The vaporization assembly 60, the vent tube 70, and the piston 80 are arranged in the liquid storage housing 10.

The liquid storage housing 10 is in a cylindrical shape with openings at both ends, and the vent tube 70 is in a cylindrical shape. The vent tube 70 is longitudinally arranged in the liquid storage housing 10 and may be coaxially arranged with the liquid storage housing 10. An output channel 71 configured to output the aerosol is defined on the inner surface of the vent tube 70. A liquid storage cavity 11 is annular and defined between the outer surface of the vent tube 70 and the inner surface of the liquid storage housing 10. It may be understood that in other embodiments a cross-sectional shape of the liquid storage housing 10 and/or the vent tube 70 may also be a shape such as oval, racetrack, or rectangular. In other embodiments, the vent tube 70 and the liquid storage housing 10 may also be arranged in different axes.

The piston 80 is arranged in the liquid storage cavity 11 and can seal the upper end of the liquid storage cavity 11. Specifically, a through hole 83 for the vent tube 70 to pass through in the longitudinal direction is arranged on the piston 80. A hole wall surface of the through hole 83 (that is, the inner surface of the piston 80) is air-sealed with the outer surface of the vent tube 70, and the outer surface of the piston 80 is air-sealed with the inner surface of the liquid storage housing 10. The piston 80 may be made of an elastic material such as silica gel, or may be made of a hard material such as plastic.

Further, the piston 80 can also move up and down relative to the liquid storage housing 10 and the vent tube 70, thereby changing a volume of the liquid storage cavity 11 and balancing an air pressure in the liquid storage cavity 11. Specifically, the piston 80 has a first surface 81 and a second surface 82 arranged opposite each other along a moving direction. In this embodiment, the first surface 81 and the second surface 82 are respectively the upper end surface and the lower end surface of the piston 80. The second surface 82 faces the liquid storage cavity 11, and the second surface 82, the outer surface of the vent tube 70, and the inner surface of the liquid storage housing 10 jointly define the liquid storage cavity 11. The first surface 81 is in communication with the atmosphere, so that the piston 80 can move under an action of an external atmospheric pressure.

A sum of a first friction force and a second friction force is greater than the gravity of the piston 80, so that a force difference is formed between the sum of the first friction force and the second friction force and the gravity of the piston 80. On the one hand, the force difference can prevent the piston 80 from moving downward under the force of gravity. On the other hand, when the liquid substrate in the liquid storage cavity 11 decreases, the air pressure in the liquid storage cavity 11 decreases to form a negative pressure in the liquid storage cavity 11. When the negative pressure is greater than the force difference, the piston 80 moves downward, reducing the volume of the liquid storage cavity 11, thereby increasing the air pressure in the liquid storage cavity 11. In this way, the liquid substrate in the liquid storage cavity 11 can be smoothly fed to the vaporization assembly 60, so as to avoid unsmooth or impossible feeding of the liquid due to the excessively small air pressure in the liquid storage cavity 11, and avoid dry heating of the vaporization assembly 60 due to insufficient feeding. In addition, when the liquid storage cavity 11 is in a high-temperature and high-pressure state and an increase of the air pressure in the liquid storage cavity 11 is caused, the piston 80 can also be pushed upward, thereby increasing the volume of the liquid storage cavity 11 and reducing the air pressure in the liquid storage cavity 11.

Further, the inner surface and the outer surface of the piston 80 can respectively protrude to form a seal ring 831 and a seal ring 841, which are annular. The inner surface of the piston 80 is in seal-fit with the outer surface of the vent tube 70 through the seal ring 831. The outer surface of the piston 80 is in seal-fit with the inner surface of the liquid storage housing 10 through the seal ring 841. On the one hand, a sealing performance can be improved, and on the other hand, a friction force when the piston 80 slides relative to the liquid storage housing 10 and the vent tube 70 can be reduced.

The mouthpiece 90 is arranged on the upper end of the liquid storage housing 10, and an inhalation channel 91 that is in communication with the output channel 71 is formed inside the mouthpiece along the longitudinal direction. In some embodiments, the mouthpiece 90 may include a mouthpiece portion 92, a limiting portion 93, and a sleeve portion 94 sequentially arranged from top to bottom. The inhalation channel 91 may extend longitudinally downward to the lower end surface of the sleeve portion 94 from the upper end surface of the mouthpiece portion 92. An outer diameter of the lower end of the mouthpiece portion 92, an outer diameter of the limiting portion 93, and an outer diameter of the sleeve portion 94 are sequentially reduced. The sleeve portion 94 can be embedded in the upper end of the vent tube 70 by riveting or the like, so as to communicate the inhalation channel 91 with the upper end of the output channel 71. A stepped surface 934 is annular and formed at the connection between the limiting portion 93 and the sleeve portion 94, and the upper end surface of the vent tube 70 can abut against the stepped surface 934.

As shown in FIG. 3, when the piston 80 is in a first position, the upper end surface of the piston 80 abuts against the stepped surface 934, and the upper end surface of the piston 80 is flush with the upper end surface of the liquid storage housing 10, which is beneficial to maximize the use of the space of the vaporizer 100 in the axial direction. A space is formed between the upper end surface of the liquid storage housing 10 and the piston 80 and the lower end surface of the mouthpiece portion 92, so that an air cavity 810 is annular and formed between the liquid storage housing 10 and the upper end surface of the piston 80, the lower end surface of the mouthpiece portion 92, and the outer surface of the limiting portion 93. The air cavity 810 is directly in communication with the atmosphere, so that the operation such as opening in the liquid storage housing 10 can be avoided. It may be understood that in other embodiments, when the piston 80 is in an initial position, the upper end surface of the piston 80 may also be slightly higher or slightly lower than the upper end surface of the liquid storage housing 10.

As shown in FIG. 4, as the liquid substrate in the liquid storage cavity 11 is continuously consumed, the air pressure in the liquid storage cavity 11 gradually decreases, and the piston 80 gradually moves down to the second position under an action of an external atmospheric pressure, thereby restoring the air pressure in the liquid storage cavity 11.

It may be understood that the above embodiments are only a simplified model of the utility model. On a premise of not deviating from the technical principle of the utility model, the structural form can be improved and the components can be increased or decreased. For example, the mouthpiece 90 may not be provided with the limiting portion 93, and the upper end surface of the vent tube 70 may directly abut against the lower end surface of the mouthpiece portion 92. For another example, the mouthpiece 90 may not be provided with the sleeve portion 94, and the upper end of the vent tube 70 may be embedded in the mouthpiece 90. For another example, a limiting structure may be arranged on the inner surface of the liquid storage housing 10 and/or the outer surface of the vent tube 70 to limit the first position of the piston 80. For still another example, the upper end surface of the liquid storage housing 10 may abut against the lower end surface of the mouthpiece portion 92, and then the first surface 81 of the piston 80 is communicated to the atmosphere by opening a hole in a side wall of the liquid storage housing 10 or the mouthpiece portion 92.

As shown in FIG. 3 to FIG. 5, the vaporization assembly 60 includes a liquid absorbing element 61, a heating element 62 arranged on the liquid absorbing element 61, and an electrode lead 63 and an electrode lead 64 respectively connected to two poles of the heating element 62. The liquid absorbing element 61 has a porous microporous structure, which may include one or more of liquid absorbing cotton, porous ceramics, or the like. The liquid absorbing element 61 is in fluid communication with the liquid storage cavity 11, which is capable of absorbing the liquid substrate from the liquid storage cavity 11 through infiltration and the capillary effect of an internal microporous structure of the liquid absorbing element and transfers the liquid substrate to the heating element 62. The heating element 62 is configured to heat and vaporize the liquid substrate absorbed in the liquid absorbing element 61 after being energized, and the aerosol formed after the vaporization is sequentially outputted to the outside world through the output channel 71 and the inhalation channel 91. The heating element 62 may be a heating film and may be integrally formed on the liquid absorbing element 61 by screen printing or printing. Alternatively, the heating element 62 may be a heating element structure such as a metal heating plate or a metal heating wire that is separately formed.

In some embodiments, the vaporization assembly 60 may be accommodated in the vent tube 70, and a side wall of the vent tube 70 also defines at least one liquid feeding hole 72 that communicates the liquid absorbing element 61 with the liquid storage cavity 11. Further, in this embodiment, the side wall of the vent tube 70 defines a plurality of liquid feeding holes 72, and the plurality of liquid feeding holes 72 are evenly spaced along a circumferential direction of the vent tube 70. The liquid absorbing element 61 is in a cylindrical shape and is longitudinally arranged in the vent tube 70. The inner surface of the liquid absorbing element 61 defines a vaporization cavity 610 that is in communication with the output channel 71. The heating element 62 is arranged on the inner surface of the liquid absorbing element 61.

The base 20 includes a base portion 21. The base portion 21 is embedded in an opening of the lower end of the liquid storage housing 10 to seal the opening of the lower end of the liquid storage housing 10. A liquid storage cavity 11 is formed between the upper end surface of the base portion 21, the lower end surface of the piston 80, the outer surface of the vent tube 70, and the inner surface of the liquid storage housing 10.

Further, the base 20 may further include a flange portion 22 extending downwardly from the base portion 21 and a connecting portion 23 extending downwardly from the flange portion 22. An outer diameter of the flange portion 22 is greater than an outer diameter of the base portion 21, and the upper end surface of the flange portion 22 can abut against the lower end surface of the liquid storage housing 10, to realize mounting and positioning between the base 20 and the liquid storage housing 10. An external thread configured to engage with an internal thread in the power supply device 200 is arranged on the outer surface of the connecting portion 23, so that the vaporizer 100 and the power supply device 200 can be fixed to each other by screwing.

The upper end surface of the base portion 21 may extend longitudinally downward to form an upper mounting hole 210. The lower end surface of the connecting portion 23 is formed with a lower mounting hole 230 that is in communication with the upper mounting hole 210 extending upward in the longitudinal direction. The lower end of the vent tube 70 may be embedded in the upper mounting hole 210, and the vent tube 70 may be made of a conductive material such as metal, which may be electrically connected to the electrode lead 63. The base 20 may also have an electrode pin 50 threaded along the longitudinal direction. The electrode pin 50 is electrically connected to the electrode lead 64.

A tube-shaped insulating sleeve 40 may also be arranged in the base 20 to insulate and isolate the vent tube 70 from the electrode pin 50. The outer surface of the insulating sleeve 40 may be protruded to form a flange 42. The flange 42 can abut against the lower end surface of the vent tube 70 and/or the lower end surface of the upper mounting hole 210 to achieve the positioning of the insulating sleeve 40 in the base 20. A space may also be formed between the upper end surface of the insulating sleeve 40 and a bottom surface of the liquid absorbing element 61 to facilitate heat insulation.

An electrode hole 41 configured to be sleeved on by the electrode pin 50 is arranged in the insulating sleeve 40 along the longitudinal direction. The electrode pin 50 is longitudinally arranged in electrode hole 41. The lower end of the vent tube 70 is arranged between the outer surface of the insulating sleeve 40 and the inner surface of the base 20. Further, the inner surface of the electrode hole 41 may also be recessed outwardly to form a wire groove 44 through which the electrode lead 64 passes. The lower end of the electrode lead 64 can extend into the wire groove 44 and contact and be connected to the inner surface of the electrode hole 41; and the outer surface of the electrode hole 41 can be concave to form a wire groove 43 through which the electrode lead 63 passes. The lower end of the electrode lead 63 can extend into the wire groove 43 and contact and be connected to the inner surface of the vent tube 70, so that a welding operation can be avoided. The insulating sleeve 40 can be made of an insulating elastic material such as silica gel, which can elastically clamp the electrode lead 64 between the wire groove 44 and the outer surface of the electrode pin 50, to ensure reliability of an electrical connection between the electrode lead 64 and electrode pin 50. Besides, the electrode lead 63 can be elastically clamped between the wire groove 43 and the inner surface of the vent tube 70 to ensure the reliability of the electrical connection between the electrode lead 63 and the vent tube 70. It may be understood that, in other embodiments, connections between the electrode lead 64 and the electrode pin 50, and between the electrode lead 63 and the vent tube 70 can also be connected by welding or the like. In other embodiments, the insulating sleeve 40 may also be made of a rigid insulating material such as plastic.

It may be understood that in other embodiments, the vent tube 70 may also be made of a non-conductive material. In this case, two electrode pin s may be sleeved on the base 20. The two electrode pin s are respectively connected with the electrode lead 63 and the electrode lead 64; or the two electrode pin s may also directly contact and be connected to the heating element 62.

In some embodiments, at least one air inlet hole 231 may be further formed on a side wall of the connecting portion 23. An airflow gap 232 is formed between the outer surface of the insulating sleeve 40 and the inner surface of the lower mounting hole 230. An airflow hole 51 extends through the electrode pin 50 in the longitudinal direction. The at least one air inlet hole 231, the airflow gap 232, and the airflow hole 51 are sequentially in communication with each other to form an air inlet channel for introducing the outside airflow into the vaporization cavity 610. In this embodiment, two air inlet holes 231 are arranged and are respectively located on two opposite sides of the connecting portion 23 in the circumferential direction.

In some embodiments, at least one air guide groove 45 may be further formed by recessing the bottom surface of the insulating sleeve 40 upward. In this embodiment, two air guide grooves 45 are arranged and are respectively located on two opposite sides of the insulating sleeve 40 in the circumferential direction. Each air guide groove 45 extends inward in a radial direction from the outer side of the bottom surface of the insulating sleeve 40 to be brought into communication with the electrode hole 41. When the vaporizer 100 is connected to the power supply device 200, the bottom surface of the insulating sleeve 40 may abut against and fit with the components in the power supply device 200, and the airflow gap 232 and the airflow hole 51 may be brought into communication with each other through the air guide groove 45.

In some embodiments, the vaporizer 100 may further include a fixing sleeve 30. The fixing sleeve 30 is sleeved outside the lower end of the liquid storage housing 10 and the base 20, which can enhance connection reliability of each component in the liquid storage housing 10.

It may be understood that the foregoing technical features can be used in any combination without limitation.

The foregoing embodiments only describe specific implementations of the utility model, which are described specifically and in detail, but cannot be construed as a limitation to the patent scope of the utility model. It should be noted that, for a person of ordinary skill in the art, the foregoing technical features may be combined freely, and several transformations and improvements can be further made without departing from the idea of the utility model. These transformations and improvements all fall within the protection scope of the utility model. Therefore, any equivalent change or modification made according to the scope of the claims of the utility model shall fall within the scope of the claims of the utility model.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A vaporizer, comprising:

a liquid storage housing;

a vent tube arranged in the liquid storage housing, a liquid storage cavity being formed between an inner surface of the liquid storage housing and an outer surface of the vent tube;

a piston sealingly arranged between the inner surface of the liquid storage housing and the outer surface of the vent tube, the piston having a first surface and a second surface arranged opposite each other, the first surface being in communication with atmosphere, the second surface being in communication with the liquid storage cavity; and a mouthpiece arranged at an upper end of the liquid storage housing, the mouthpiece comprising a mouthpiece portion, wherein an annular air cavity is formed between a lower end surface of the mouthpiece portion and the first surface, the annular air cavity being in communication with the atmosphere through an annular spacing formed between the lower end surface of the mouthpiece portion and the upper end surface of the liquid storage housing, and wherein the piston is movable in the liquid storage housing under air pressure of the atmosphere so as to change a volume of the liquid storage cavity, and wherein the annular spacing is arranged at a radially outermost periphery of the vaporizer such that air from the atmosphere is configured to enter the annular spacing in a radially inward direction from the radially outermost periphery and subsequently enter the annular air cavity as the piston moves away from the mouthpiece.

2. The vaporizer of claim 1, wherein the annular spacing is delimited by a length of a limiting portion in a longitudinal direction by which the limiting portion protrudes from the lower end surface of the mouthpiece portion.

3. The vaporizer of claim 1, wherein an inner surface of the piston protrudes to form a first seal ring, which is annular, and the first seal ring is in seal-fit with the outer surface of the vent tube.

4. The vaporizer of claim 3, wherein an outer surface of the piston protrudes to form a second seal ring, which is annular, and the second seal ring is in seal-fit with the inner surface of the liquid storage housing.

5. The vaporizer of claim 1, wherein the mouthpiece further comprises a limiting portion extending downward and protruding from the lower end surface of the mouthpiece portion, and wherein the piston has a first position abutting against the limiting portion.

6. The vaporizer of claim 5, wherein the mouthpiece further comprises a sleeve portion extending downward from the limiting portion, and wherein the sleeve portion is embedded in the vent tube.

7. The vaporizer of claim 5, wherein the upper end surface of the liquid storage housing and the first surface of the piston are flush with one another along a radial direction when the piston is in the first position.

8. The vaporizer of claim 5, wherein the first position is a maximum position of the piston in a longitudinal direction toward the mouthpiece.

9. The vaporizer of claim 1, further comprising:

a vaporization assembly arranged in the liquid storage housing, the vaporization assembly comprising a liquid absorbing element in fluid communication with the liquid storage cavity and a heating element arranged in the liquid absorbing element.

10. The vaporizer of claim 9, wherein the vaporization assembly is arranged in the vent tube.

11. The vaporizer of claim 9, further comprising:

a base arranged at a lower end of the liquid storage housing and an electrode pin extending through the base, wherein the electrode pin is electrically connected to a first electrode of the liquid absorbing element.

12. The vaporizer of claim 11, further comprising:

an insulating sleeve arranged between an inner surface of the vent tube and an outer surface of the electrode pin.

13. The vaporizer of claim 11, wherein a lower end of the vent tube is embedded in the base.

14. The vaporizer of claim 13, wherein the vent tube is conductive, and wherein the vent tube is electrically connected to a second electrode of the liquid absorbing element.

15. An electronic vaporization device, comprising:

the vaporizer of claim 1.

* * * * *